US006569067B1

(12) United States Patent
Madole

(10) Patent No.: US 6,569,067 B1
(45) Date of Patent: May 27, 2003

(54) METHOD AND APPARATUS FOR REHABILITATING THE SHOULDER

(75) Inventor: Darrin E. Madole, Irvine, CA (US)

(73) Assignee: Balanced Health, Inc., Santa Ana, CA (US)

( * ) Notice: Subject to any disclaimer, the term of this patent is extended or adjusted under 35 U.S.C. 154(b) by 0 days.

(21) Appl. No.: 09/453,664

(22) Filed: Dec. 3, 1999

(51) Int. Cl.[7] ..... A63B 71/00

(52) U.S. Cl. ..... 482/148; 482/905; 482/907; 128/878; 128/879

(58) Field of Search ..... 482/148, 44–46, 482/75, 76, 905; 272/67; 135/68; 432/258; 602/5, 19, 20, 21; 128/878, 879

(56) References Cited

U.S. PATENT DOCUMENTS 4,245,659 A * 1/1981 Shofner ..... 135/68
4,254,948 A * 3/1981 Jacobs ..... 482/68
4,257,591 A * 3/1981 Evans ..... 272/125
4,417,569 A * 11/1983 Brudny ..... 128/77
4,417,727 A * 11/1983 Ottenheimer ..... 272/125
4,671,260 A * 6/1987 Buckner ..... 128/76 R
4,688,794 A * 8/1987 Clairmont et al. ..... 272/93
4,924,894 A * 5/1990 Martinez ..... 135/65
5,178,595 A * 1/1993 MacGregor
5,348,035 A * 9/1994 Porter ..... 135/66
5,385,536 A * 1/1995 Burkhead et al. ..... 602/20
5,538,499 A * 7/1996 Schwenn et al. ..... 602/20
5,671,765 A * 9/1997 Hagberg, Jr. ..... 135/68
5,755,644 A * 5/1998 Breems ..... 482/67
5,919,116 A * 7/1999 Edell ..... 482/11
6,027,434 A * 2/2000 Gibbons ..... 482/131
6,129,650 A * 10/2000 Wedge ..... 482/139

* cited by examiner

*Primary Examiner*—Nicolas D. Lucchesi
*Assistant Examiner*—Lori Baker Amerson
(74) *Attorney, Agent, or Firm*—Stout, Uxa, Buyan & Mullins, LLP; Donald E. Stout

(57) ABSTRACT

A device, together with a method for its use, for ensuring that a patient's limb is maintained in a steady, predetermined oriented relative to the torso of the patient during an entire exercise routine. The device is versatile and, through particularly adapted to benefit shoulder rehabilitation and strengthening therapy, may potentially also be utilized for many other types of therapy related to any limb. The device comprises a first member for supporting the extremity of the patient, a second member for engaging the torso of the patient, and a third member for connecting the first and second members. In its preferred embodiments, the third member comprises a telescoping shaft, which is adjustable to a plurality of potentially desirable lengths. The second member preferably comprises a tubular structure having an arcuate configuration, being generally "C"-shaped and having a convex side and a concave side, wherein the concave side thereof is adapted to engage the torso of the patient. Similarly, the first member is also preferably generally "C"-shaped, having a convex side and a concave side, wherein the concave side thereof is adapted to support the arm of the patient.

19 Claims, 2 Drawing Sheets

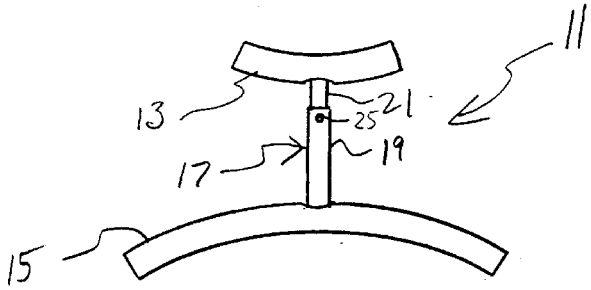
Fig. 1A
Fig. 1B
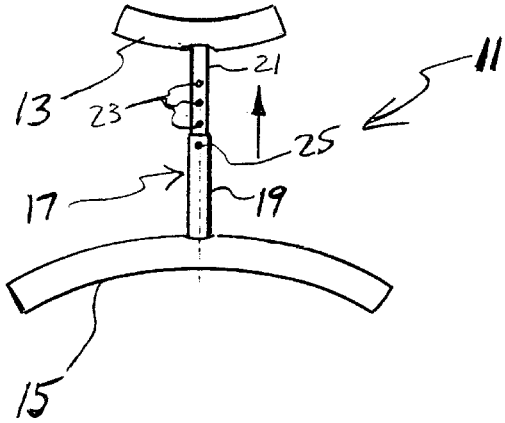
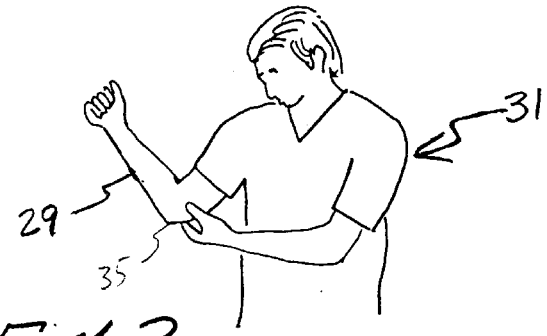
Fig. 2
Fig 3
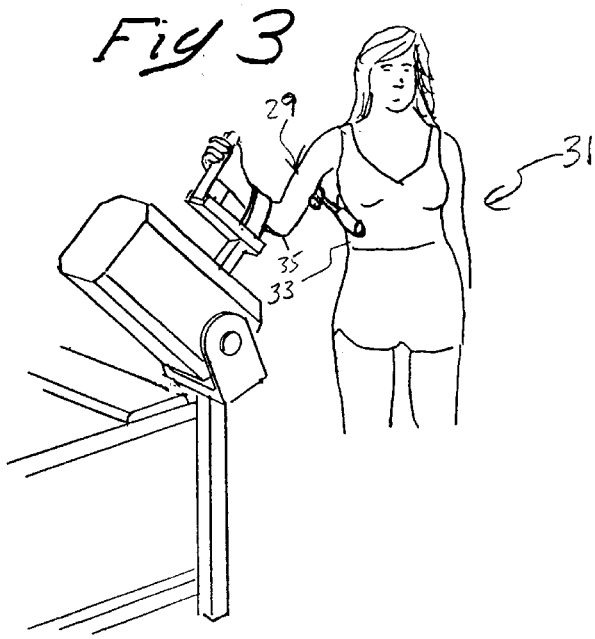
Fig 7
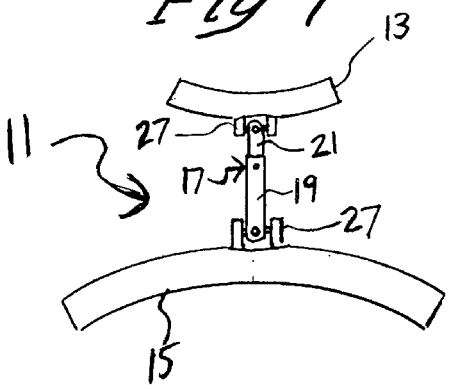

METHOD AND APPARATUS FOR REHABILITATING THE SHOULDER

BACKGROUND OF THE INVENTION

This invention relates generally to exercise devices, and more particularly to a device which is especially useful for assisting in the performance of effective strengthening and rehabilitation exercises for the shoulder.

The rotator cuff or musculotendinous cuff consists of the fibers of the supraspinatus, infra-spinatus, teres minor, and subscapularis muscles, which blend with and reinforce the capsule of the shoulder joint. The rotator cuff is important because degeneration and subsequent tearing of its tendon of insertion is rather common pathology which results in restriction of shoulder movement, especially in abduction. Other common shoulder overuse injuries include impingement syndrome, rotator cuff dysfunction, rotator cuff strains, tendinitus, and chronic, recurrent, or functional subluxation instabilities. It is therefore very important to keep these muscles strong and in good range of movement.

It is well accepted practice among those skilled in the art of shoulder rehabilitation and development, that exercise routines which are conducted with the arm oriented in the plane of the scapula, wherein the mechanical axis of the glenohumeral joint is in line with the mechanical axis of the scapula, are advantageous. The reason for this is that, in this alignment, the glenohumeral capsule is lax, and the deltoid and rotator cuff muscles are optimally positioned to elevate the limb. Because rotator cuff muscle attachment is from the scapula to the humerus, reorienting the humerus into the plane of the scapula increases the length of these muscles, and improves their length-tension relationship, a result that presumably facilitates optimal muscle force (see, for example, *The Athlete's Shoulder,* edited by James Andrews & Kevin Wilk (1994), chapters 42 and 43, herein expressly incorporated by reference.

The problem, in practice is to obtain this desired limb position, and to maintain it during an entire exercise set. Because of fatigue and the activity involved in the exercise routine, the patient's limb can easily slip out of the most effective position for performing the routine, often without the patient being aware that this has occurred. Furthermore, the concept of maintaining one's limb in the plane of the scapula is a rather abstract one for a lay patient, and they may have no idea, once the position of their limb has been compromised, as to how to restore it to the desired orientation for the balance of their exercise set. Thus, unless the therapist who initiated the exercise stands watch over that patient during the entire set (a highly inefficient and expensive proposition), restoring the arm to its proper position whenever it moves the effectiveness of the exercise may be compromised.

Prior art solutions to this problem have generally included such makeshift approaches as rolling up a towel and placing the towel between the limb and the torso of a patient, in an attempt to prop the limb in an orientation which approximates the desired one.

What is needed, therefore, is a device which is specifically adapted to assist in supporting a patient's limb in an orientation which is most effective for performing a particular exercise routine.

SUMMARY OF THE INVENTION

The present invention solves the foregoing problem by providing a simple, easy to use, reliable device for ensuring that a patient's limb is maintained in a steady, predetermined orientation relative to the torso of the patient during an entire exercise routine. The device is versatile and, though particularly adapted to benefit shoulder rehabilitation and strengthening therapy, may potentially also be utilized for many other types of therapy related to any limb.

More particularly, there is provided a device for rehabilitating or strengthening an extremity of a patient, preferably the shoulder, which comprises a first member for supporting the extremity of the patient, a second member for engaging the torso of the patient, and a third member for connecting the first and second members. In its preferred embodiments, the third member comprises a telescoping shaft, which is adjustable to a plurality of potentially desirable lengths.

The second member preferably comprises a tubular structure having an arcuate configuration, being generally "C"-shaped and having a convex side and a concave side, wherein the concave side thereof is adapted to engage the torso of the patient. Similarly, the first member is also preferably generally "C"-shaped, having a convex side and a concave side, wherein the concave side thereof is adapted to support the arm of the patient.

In another aspect of the invention, a method for rehabilitating or strengthening an extremity of a patient is disclosed, using a device comprising a first member for supporting the extremity of a patient, a second member for engaging the torso of the patient, and a third member for joining the first and second members. The preferred method comprises the steps of engaging the second member with the torso of the patient, so that the first member is disposed in a position remote from the torso, supporting the extremity with the first member, and beginning a desired exercise routine.

The invention, together with additional features and advantages thereof, may best be understood by reference to the following description taken in conjunction with the accompanying illustrative drawing.

BRIEF DESCRIPTION OF THE DRAWINGS

FIG. 1A is a plan view of a shoulder rehabilitation device constructed in accordance: with the principles of the present invention wherein the device is illustrated in a retracted configuration;

FIG. 1B is a plan view similar to FIG. 1A, wherein the inventive device is illustrated in an extended configuration;

FIG. 2 is view showing a shoulder rehabilitation patient with his arm manipulated to an orientation desirable for performing rehabilitation exercises;

FIG. 3 is view showing a shoulder rehabilitation patient utilizing the inventive device shown in FIGS. 1A and 1B to perform rehabilitation exercises;

FIG. 7 is a view similar to FIG. 1 of a modified embodiment of the inventive device.

DESCRIPTION OF THE PREFERRED EMBODIMENT

Figure 4:
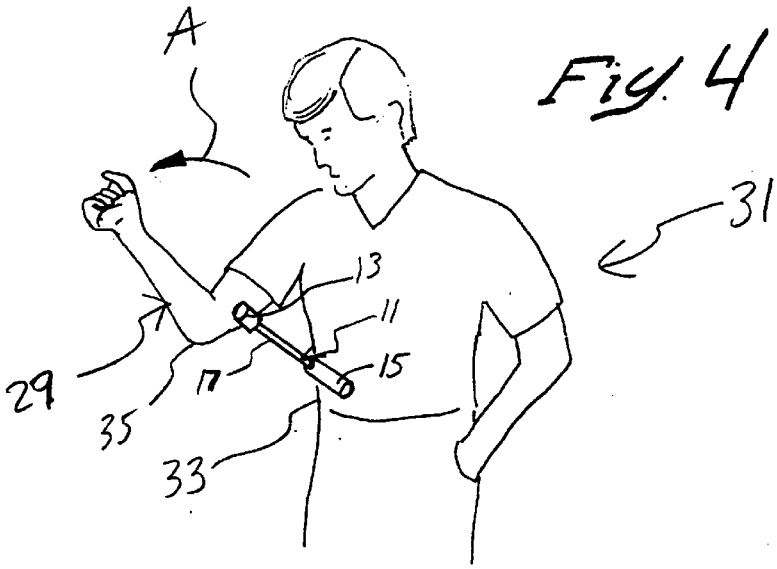
FIG. 4 is a view similar to FIG. 2 of a shoulder rehabilitation patient using the inventive device to assist in maintaining his arm and shoulder in an externally rotated orientation desirable for performing rehabilitative exercises.

Referring now more particularly to the drawings, there is shown in FIGS. 1A and 1B a first preferred embodiment of a shoulder rehabilitation device 11 which is constructed in accordance with the principles of the present invention. The device 11 comprises an arm supporting member 13, which is preferably arcuate in configuration, having a general "C" shape, a torso engaging member 15, which also is arcuate, having a general "C" shape, and a shaft or slide arm 17. The shaft 17 is attached at either of its ends to both the arm supporting member 13 and the torso engaging member 15, thereby functioning to connect the members 13 and 15. In the preferred embodiment, the shaft 17 is adjustable in length. As shown, the shaft 17 is telescopic, comprising a first shaft portion 19 and a second shaft portion 21, and is fixable at various predetermined lengths by means of a latching mechanism, of any known type. In the illustrated embodiment, a series of spaced apertures 23 are disposed on the second inner shaft portion 21, and a single aperture 25 is disposed on the first outer shaft portion 19, as shown in FIG. 1B. When it is desired to adjust the length of the shaft 17, the shaft portions 19 and 21 are slid axially relative to one another until the apertures 23 and 25 are aligned which correspond to the desired length of the shaft 17 for a particular application, after which a locking pin or the like is disposed through both aligned apertures to lock the shaft 17 at the desired length. This illustrated arrangement is merely exemplary, and not limiting.

In the preferred embodiment, members 13 and 15, and the shaft 17 may all be fabricated of hollow tubular material, which is rigid and sufficiently strong to maintain a patient's arm in a desired position relative to the patient's body during an exercise regimen, as will be discussed in more detail hereinbelow. Such materials may include, for example, polyvinyl chloride (PVC) or other rigid plastic materials, or metal. In one preferred embodiment shaft portion 21 is fixedly attached to arm supporting member 13, and shaft portion 19 is fixedly attached to torso engaging member 15, which fixed attachments may be attained by welding, gluing, or mechanically securing the respective members together, or by molding the two attached members as a single piece, or by any other known method. The arm supporting member 13 and the torso engaging member 15, respectively, may be padded if desired, to afford the patient additional comfort. This may be accomplished by providing a foam covering, or by other known means.

In another preferred embodiment, illustrated in FIG. 7, each of the supporting member 13, and the engaging member 15 are attached to their respective shaft portions 21, 19, by swivel joints 27, of any known type, so that the supporting member 13 and the engaging member 15 may each be pivoted relative to the shaft 17. A universal ball joint 27 can be utilized, for example, to provide the option for rotation of the supporting member 13 and/or the engaging member 15 in any direction relative to the shaft 17. It is also within the scope of the present invention to employ a combination of fixed and swivel joints; i.e. the arm supporting member 13 can be fixedly attached to the shaft portion 21, while the torso engaging member 15 can be pivotally attached to the shaft portion 19, and vice versa.

Now with reference in particular to FIGS. 2–6, various methods for using the inventive device will be described. In general, the inventive device 11 is versatile in that it may be used in exercises involving a patient being seated, standing, lying on one's side, supine, kneeling, one-half kneeling, and in an aquatic environment, as well as a non-aquatic environment. The inventive method involves first determining a desired modified neutral angle for a patient's arm, as shown in FIG. 2. For a particular desired exercise, the arm 29 of a patient 31 is manually moved to a desired angle, by the patient himself, a spotter, or a trainer, in a known manner. This involves orienting the arm 29 in the plane of the patient's scapula, which means that the mechanical axis of the glenohumeral joint is in line with the mechanical axis of the scapula (this constitutes the "modified neutral position"), and then orienting the arm into a desired angle within the scapular plane.

Once the arm 29 is in a desired position, the shoulder rehabilitation device 11 is held next to the arm in order to customize its length relative to the length of the patient's arm. As described supra, the length of the device 11 is adjusted by adjusting the length of the shaft 17, by sliding the two shaft portions 19 and 21 relative to one another, in a telescoping manner, until the desired length is reached, and then disposing a pin or the like into the corresponding apertures 23, 25 to lock the shaft 17 at its desired length.

In use, for a desired exercise, as shown in FIGS. 3–6, once the length of the shaft 17 has been adjusted as desired, the device is employed by placing the torso engaging member 15 against the torso 33 of a patient 31, as illustrated. It should be positioned so that the arm 29 of the patient lies in the plane of the scapula of the patient, and so that a desired modified neutral angle is achieved when the arm 29 rests on the arm supporting member 13 of the device 11, at a location near the elbow 35. Once the arm 29 is firmly supported by the device 11 in its desired modified neutral position, the exercise/strengthening routine may commence.

Figure 5:
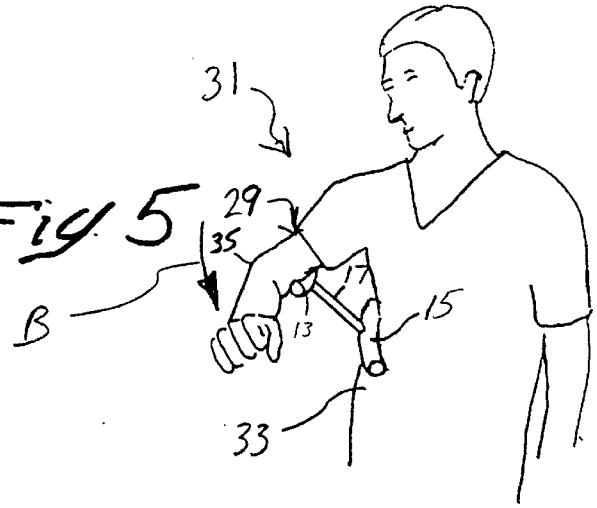
FIG. 5 is a view similar to FIG. 4 showing a patient using the inventive device to assist in maintaining his arm and shoulder in an internally rotated orientation desirable for performing rehabilitative exercises.
Figure 6:
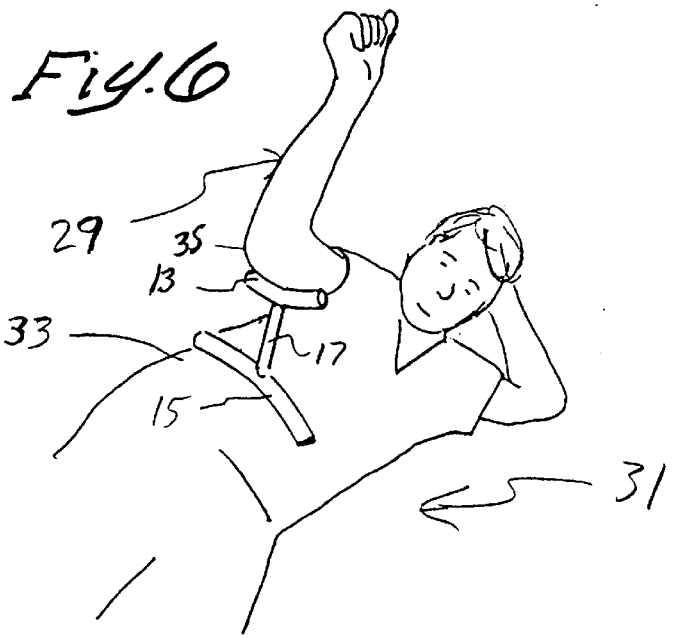
FIG. 6 is a view similar to FIGS. 4 and 5 showing a shoulder rehabilitation patient in a sideways-lying position and using the inventive device to assist in the performance of shoulder rehabilitation exercises.

As shown in FIGS. 3–6, and as discussed supra, the inventive device 11 is extremely versatile, and can be used for a wide variety of exercises and routines. For example, as shown in FIGS. 3–5, it can be used in a standing position, or, as shown in FIG. 6, in a position where the patient is lying on his side. FIG. 4 illustrates the use of the device 11 for exercises requiring external rotation of the arm (note arrow A), while FIG. 5 illustrates the use of the device for exercises requiring internal rotation of the arm (note arrow B).

Of course, although the inventive shoulder rehabilitation device 11 is particularly useful for assisting in the performance of exercises which are designed to be performed with the arm set in a modified neutral position (scapular plane position), it may be used for a wide variety of other purposes as well. For example, if non-plane of scapula exercise is desired, the aforementioned method can be followed, except that the device 11 is placed in the desired plane other than the scapular plane when setting it onto the torso 33 of the patient 31.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A device for rehabilitating or strengthening an extremity of a patient, comprising:

a first member for supporting the extremity of the patient, said first member being engageable with but not attachable to the extremity;

a second rigid member for engaging the torso of the patient, said second member being generally "C" shaped, having a concave side, wherein the concave side is adapted to engage, but not be attachable to, the patient's torso; and a third rigid member having first and second opposing ends for connecting said first and second members, said first member being disposed at said first opposing end and said second member being disposed at said second opposing end.

2. The device as recited in claim 1, wherein said third member comprises a rigid shaft.

3. The device as recited in claim 2, wherein said shaft is adjustable to a plurality of potentially desirable lengths.

4. The device as recited in claim 3, wherein said shaft comprises a telescoping shaft, having a first shaft portion and a second shaft portion.

5. The device as recited in claim 4, wherein said telescoping shaft further comprises structure for permitting said two shaft portions to be axially fixed relative to one another in a plurality of positions, such that said plurality of potentially desirable lengths may be achieved.

6. The device as recited in claim 1, wherein said first member is generally "C" shaped, having a concave side, and wherein the concave side is adapted to accommodate an arm of said patient.

7. The device as recited in claim 1, wherein said third member is pivotally joined to at least one of said first and second members.

8. The device as recited in claim 1, wherein said third member is pivotally joined to each of said first and second members.

9. A method for rehabilitating or strengthening a portion of a patient's body, using a device comprising a first member for supporting an arm of the patient, a second member for engaging the torso of the patient, and a third member for joining the first and second members, the method comprising the steps of:

engaging the second member with the torso of the patient, without attaching the second member to the torso, so that the first member is disposed in a position remote from the torso;

supporting the arm with said first member; and moving the arm in accordance with a desired exercise routine.

10. The method as recited in claim 9, and further comprising a step of moving the arm to a desired position relative to the torso of the patient before the second member is engaged with the torso of the patient.

11. A method for rehabilitating or strengthening an extremity of a patient, using a device comprising a first member for supporting the extremity of the patient, a second member for engaging the torso of the patient, and a third member comprising a shaft which is adjustable in length for joining the first and second members, the method comprising the steps of:

engaging the second member with the torso of the patient, so that the first member is disposed in a position remote from the torso;

adjusting the length of said shaft;

supporting the extremity with said first member, without attaching said first member to the extremity; and moving the extremity in accordance with a desired exercise routine.

12. The method as recited in claim 9, wherein the step of supporting the arm comprises supporting the arm at a point near the elbow.

13. The method as recited in claim 9, wherein said first member has an arcuate configuration, with a concave side, and the step of supporting the arm includes a step of cradling a portion of the arm against the concave side of said first member.

14. A method for rehabilitating or strengthening an extremity of a patient, using a device comprising a first member for supporting the extremity of the patient, a second member having an arcuate configuration, with a concave side for engaging the torso of the patient, and a third member for joining the first and second members, the method comprising the steps of:

engaging the concave side of the second member with the torso of the patient, without attaching the second member to the torso, so that the first member is disposed in a position remote from the torso;

supporting the extremity with said first member; and moving the extremity in accordance with a desired exercise routine.

15. The device as recited in claim 1, wherein said first member is comprised of hollow tubular material.

16. The device as recited in claim 15, wherein said second member is comprised of hollow tubular material.

17. A device for rehabilitating or strengthening an arm of a patient, comprising:

a first member for supporting the extremity of the patient, said first member being generally "C" shaped, having a concave side, wherein the concave side is adapted to accommodate an arm of the patient;

a second rigid member for engaging the torso of the patient, said second member being engageable with but not attachable to the torso; and a third rigid member having first and second opposing ends for connecting said first and second members, said first member being disposed at said first opposing end and said second member being disposed at said second opposing end.

18. A device for rehabilitating or strengthening an extremity of a patient, comprising:

a first member for supporting the extremity of the patient, said first member being engageable with but not attachable to the extremity;

a second rigid member for engaging the torso of the patient, said second member being engageable with but not attachable to the torso; and a third rigid member having first and second opposing ends for connecting said first and second members, said first member being disposed at said first opposing end and said second member being disposed at said second opposing end, wherein the third rigid member is pivotally joined to at least one of said first and second members.

19. The device as recited in claim 18, wherein said third rigid member is pivotally joined to each of said first and second members.

* * * * *